US006502020B2

(12) United States Patent
Lang

(10) Patent No.: US 6,502,020 B2
(45) Date of Patent: Dec. 31, 2002

(54) DRIVING RECORD MONITORING SYSTEM AND METHOD

(76) Inventor: Brook W. Lang, 40 Lake Bellevue, Suite 100, Bellevue, WA (US) 98005

( * ) Notice: Subject to any disclaimer, the term of this patent is extended or adjusted under 35 U.S.C. 154(b) by 0 days.

(21) Appl. No.: 10/053,331

(22) Filed: Jan. 17, 2002

(65) Prior Publication Data

US 2002/0095249 A1 Jul. 18, 2002

Related U.S. Application Data

(60) Provisional application No. 60/262,557, filed on Jan. 18, 2001.

(51) Int. Cl.[7] ..... G08G 1/13

(52) U.S. Cl. ..... 701/29; 340/970; 701/208; 701/213

(58) Field of Search ..... 340/439, 995, 340/990, 991, 789; 701/29, 208, 213, 117, 201; 707/100, 104; 342/451

(56) References Cited

U.S. PATENT DOCUMENTS 5,927,040 A * 7/1999 Prabhakaram ..... 701/208
6,026,345 A * 2/2000 Shah et al. ..... 701/117
6,088,648 A * 7/2000 Shah et al. ..... 701/117
6,430,496 B1 * 6/2002 Smith et al. ..... 701/201

* cited by examiner

*Primary Examiner*—Richard M. Camby
(74) *Attorney, Agent, or Firm*—Dean A. Craine

(57) ABSTRACT

An ongoing driving habit monitoring system used by insurance companies to more accurately determine the driving habits of their policyholders or authorized drivers to more accurately determine their risk of loss. The system uses a monitoring device located in the insured party's motor vehicle. Each monitoring device is coupled to a GPS receiver, that provides physical location information, and to a wireless modem capable of connecting to a wireless communication network. The system also includes a central computer connected to a wide area network that is able to continuously or intermittently receive movement information from the monitoring device as it travels in a specific region covered by the wireless communication network. The central computer uses a driving monitoring software program and several ancillary databases containing roadway information for a region, route information, and traffic pattern information. Insurance companies or other authorized users of the system are able to log onto the central computer to the information in the database.

6 Claims, 1 Drawing Sheet

DRIVING RECORD MONITORING SYSTEM AND METHOD

This is a utility patent application based on a provisional patent application (Serial No. 60/262,557) filed on Jan. 18, 2001.

BACKGROUND OF THE INVENTION

1. Field of the Invention

This invention relates to driver habits monitoring systems and, more particularly, to systems used by motor vehicle insurance companies to assist them in determining the risk of losses of their policyholders.

2. Description of the Related Art

Motor vehicle insurance companies collect from the policyholder the names of the primary driver, the type of use (business or personal), and distance of travel. They also collect driving record information for the primary driver from state, county, and city agencies to determine the risk of losses of insuring the primary driver. Unfortunately, the information provided by the policyholder is not always accurate and delays occur before the information from the governmental agencies is available in a searchable database. Typically, insurance companies require that their agents periodically contact their policyholder to update their information. Many agents are reluctant to contact their policyholders to obtain this information because they fear they may find information that results in higher premiums or possible cancellation of the policyholder's insurance policy.

What is needed is an alternative method for obtaining accurate driving information which addresses the above-stated problems that allows insurance companies to continuously monitor the primary driver's or other authorized driver's driving habits by examining the motor vehicle usage, the actual miles driven, the driving routes, the time of day the motor vehicle is driven, the speed, etc.

SUMMARY OF THE INVENTION

It is an object of the present invention to provide an improved method of determining the risk of loss by motor vehicle insurance companies.

It is an object of the present invention to provide such a method that enables the insurance company to monitor the actual driving habits of the authorized drivers by examining the actual miles driven, the driving routes, time of travel, and speed.

It is an object of the present invention to provide such a method that can also be integrated with other databases to more accurately determine the risk of loss.

These and other objects are met by an ongoing driving record monitoring and recording system used to provide more accurate driving record information for insurance companies or other interested parties. The system uses a monitoring device located in the policyholder's or insured driver's motor vehicle, or another motor vehicle not owned but driven by the insured driver. Each monitoring device, which may be a hand-held device, a laptop computer, a PDA (Personal Digital Assistant), or an on-board computer, is coupled to a means to determine the physical location of the motor vehicle continuously or intermittently. The computer may also be connected to an optional heading or velocity collection means to continuously or intermittently determine the heading or velocity of the motor vehicle. Each monitoring device is also coupled to a wireless communication means that enables the monitoring electronic device to connect to a wide area computer network, such as the INTERNET, anywhere throughout a selected region. The system also includes a central computer connected to a wide area network and is designed to receive the movement information from the monitoring electronic device located inside the motor vehicle.

As the motor vehicle is driven in the selected region, the movement information from the monitoring device is continuously or intermittently transmitted to and processed by the central computer and recorded in the motor vehicle or driver's movement database. The movement database is constantly updated. Later, authorized insurance personnel or law enforcement personnel may download and review the movement database to obtain current or historical data.

In addition, to be connected to a velocity determining means, the monitoring device could also be attached to the original manufacturer's safety monitoring system commonly provided in new motor vehicles, such as those sold by General Motors, Inc. of Detroit, Mich. and sold under the trademark ON-STAR. Such safety monitoring systems are able to detect collisions or rollovers that are automatically reported to a central office. By connecting the motor vehicle on-board safety monitoring systems to the monitoring device, abnormal forces exerted on the motor vehicle while driving may be detected and transmitted to the central computer.

In order to use the information in the movement database, the central computer is coupled to various ancillary databases that contain specific information about the various roadways in the region, selected route information, and total distance information on selected routes. In addition, the ancillary databases may include a roadway traffic database that contains information on past, present and future traffic density and flow information and a traffic event database that contains information on past, present and future events that may affect traffic along a specific roadway or route, such as construction, sporting events, a parade, etc. By using one or more of these ancillary databases, the central computer is able to provide more accurate information on the traffic conditions that the driver must drive which an insurance company may use to determine the risk of loss.

The system is adaptable for receiving manually inputted information from the users, or other sources, such as government agencies or car rental companies, or from other monitoring devices located in motor vehicles driven by the insured driver. The system is also adaptable to download information from the central computer to the monitoring device to inform the policyholder or owner of the motor vehicle that the driver has current motor vehicle insurance coverage. Such a feature would be useful for car rental companies that must be assured that customers have motor vehicle insurance prior to renting a motor vehicle.

There has thus been outlined rather broadly, in order that the detailed description thereof that follows may be better understood, and in order that the present contribution to the art may be better appreciated, the more important features of the invention. There are additional features of the invention that will be described hereinafter and which will form the subject matter of the claims appended hereto.

DESCRIPTION OF THE PREFERRED EMBODIMENT(S)

Figure 1:
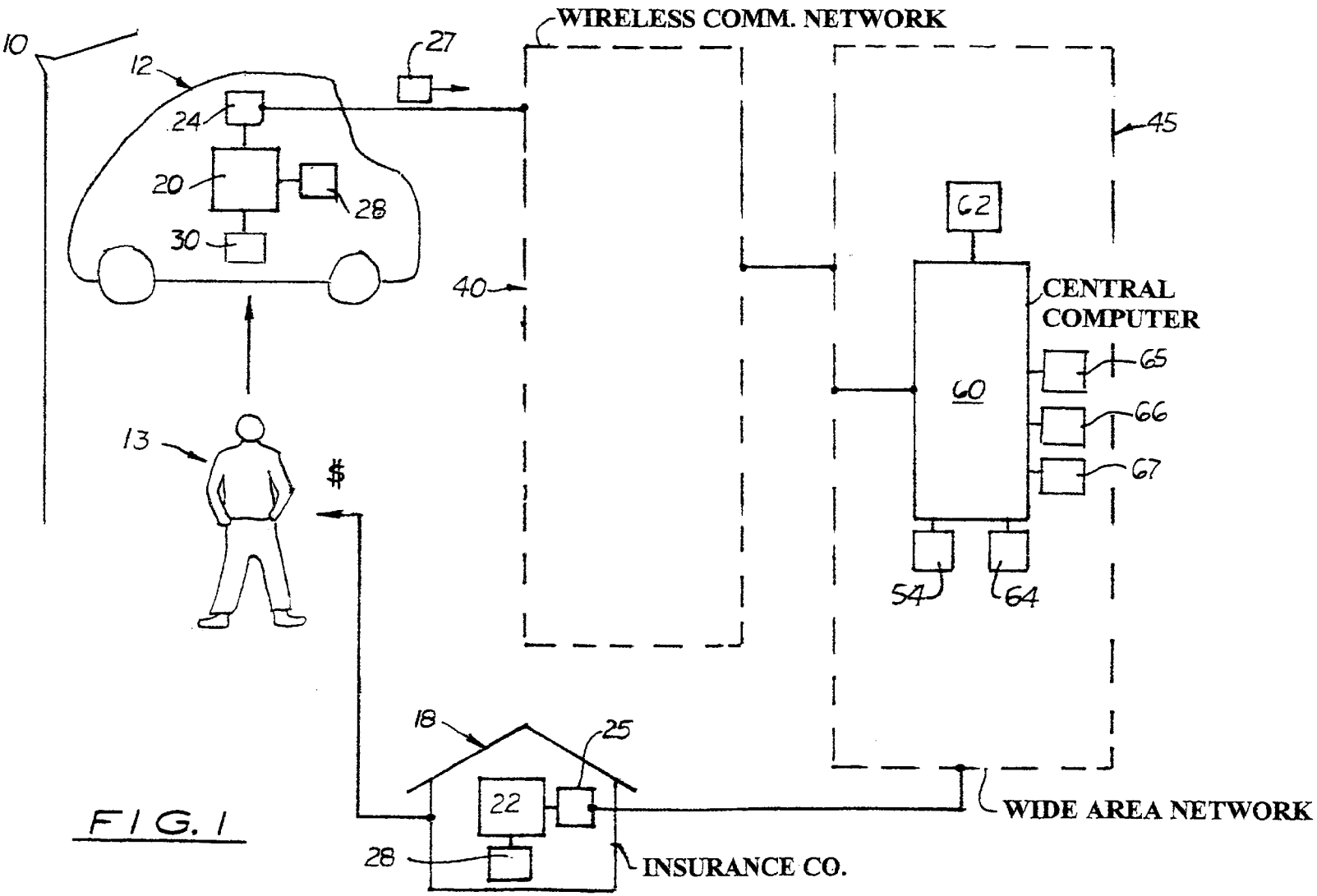
FIG. 1 is an illustration showing the driving record monitoring system disclosed.

In FIG. 1, an ongoing driving record monitoring and recording system 10 is shown, designed to provide up-todate driving information on a motor vehicle 12 or an insured driver 13 covered by a motor vehicle insurance policy. The system 10 includes a motor vehicle 12 with a monitoring device 20 located therein and capable of communicating with a central computer 60 connected to a wide area network 45. Movement information 27 from the monitoring device 20 is transferred to a central computer 60 connected to a wide area network 45 and collected in a driver's movement database 64.

The monitoring device 20, may be a hand-held device, a lap-top computer, a PDA, or an on-board computer coupled to a physical location detection means capable of instantaneously determining the physical location, heading, and elevation of the monitoring device 20, and hence, the motor vehicle 12. In addition, the monitoring device 20 may be connected to a velocity determining means, such as the motor vehicle speedometer, to determine the velocity of the motor vehicle. In other embodiments, the velocity determining means maybe a software program 62 located in the central computer 60. In still other embodiments, the monitoring device 20 may be connected to the motor vehicle safety equipment, which measures abnormal impact or forces exerted on on-board sensors as the motor vehicle 12 is driven.

Each monitoring device 20 is coupled to a wireless communication means 24 which transmits the movement information 27 over a wireless communication network 40 to the central computer 60 which is connected to a wide area network 45. The central computer 60 collects the movement information 27 as the motor vehicle 12 moves throughout the region.

The monitoring device 20 is designed to continuously, or intermittently, upload the movement information 27 to the central computer 60. Selected raw or unprocessed information in the movement database 64 may be downloaded by authorized individuals.

In the preferred embodiment, the physical location detecting means is a global positioning system (GPS) receiver 30. The GPS receiver 30 is able to immediately establish the monitoring electronic device 20 global position (i.e. latitude, longitude, elevation), heading, and velocity.

The GPS is a location system based on a constellation of twenty-four satellites orbiting the Earth at altitudes of approximately 11,000 miles. The GPS satellites provide accurate positioning information twenty-four hours per day, anywhere in the world. The GPS uses a receiver that stores orbit information for all GPS satellites. During use, the GPS receiver 30 determines the time and the positions of the overhead satellites and then calculates the amount of time it takes a GPS radio signal to travel from the satellites to the receiver. By measuring the amount of time it takes for a radio signal to travel from the satellites, the exact location of the GPS receiver 30 can be determined. GPS receivers 30 are available from Corvallis Microtechnology, Inc., in Corvallis, Oreg. It should be understood, however, that other means for automatically determining the user's physical location could be used.

In the preferred embodiment, the system 10 uses GPS receivers 30 that are 3-D coordinate receivers requiring a minimum of four visible satellites. It should be understood, however, that the system 10 could be used with 2-D coordinate receivers, which require a minimum of three satellites. The 3-D coordinate receivers are preferred, since they will continue to provide 2-D coordinate information when their views are obstructed by trees, mountains, buildings, etc.

When the GPS receiver 30 is turned on, it immediately provides a "fix" position. As it continues to operate, it records "waypoints" at pre-determined intervals (i.e. 1–5 seconds). A client-side software program 28, discussed further below, is designed to receive the fix and waypoints coordinates and transmit them to the central computer 60 as part of the movement information 27.

Loaded into the memory of each monitoring device 20 is a client-side software program 28 that is able to communicate with a server-side software program 54 loaded into the central computer 60 memory. During use, the client-side software program 28 collects the movement information 27 and uploads it constantly or at selected intervals to the central computer 60. When the driver 13 initially logs into the system 10, the client-side software program 28 also transmits the driver's identification information such as the policyholder's name and make and year of the motor vehicle. The driver 13 may also be required to enter a password.

In the preferred embodiment of the system 10, the central computer 60 is connected to the wide area network 45 and is able to communicate with one or more monitoring electronic devices 20 also connected to the wireless communication network 40 and the wide area network 45. It should be understood that the central computer 60 may be one server or a group of servers all connected to the wide area network 45. Loaded into the memory of the central computer 60 is the server-side software program 54 which is capable of uploading and processing data from the client-side software program 28 used with each monitoring device 20. The server-side software program 54 collects and saves the movement information 27 in the proper user databank. Also, coupled to the central computer 60 is policyholder information database 43 containing the driver information, and passwords for logging onto the system 10.

As shown in FIG. 1, the server-side software program 54 is also designed to interact with a plurality of ancillary databases 65, 66, 67 that enable the movement information 27 to be useful. The ancillary databases include a map database 65, a roadway traffic database 66, and a traffic event database 67.

The movement database 64 stores and updates the movement information 27 submitted by the monitoring device 20. The map database 65 processes the movement database 64 onto a map containing all of the roadways in the region. The roadway traffic database 66 contains information on past, present, or future traffic density and flow information. The traffic event database 67 contains information on past, present, or future events that may affect traffic along specific roadways or routes in the region.

During initial use, the monitoring device 20 is activated and the driver 13 enters his or her user name and password. The user name and password is then processed and transmitted to the central computer 60 which is activated to receive and process movement information 27 therefrom. As the motor vehicle 12 moves, the movement information 27 is automatically uploaded to the central computer 60 and collected in the driver's movement database 64.

The following example illustrates how the system may be used:

Driving Habit Monitoring and Reporting

The system 10 is designed to provide insurance companies 18 driving record information for their insured parties. By reviewing the movement database 64 and the other ancillary databases 65, 66, 67 coupled to the system 10, insurance companies 18 are able to determine the risk of loss when insuring a driver 13 or the motor vehicle 12.

When the risk of loss is to be considered, an authorized insurance representative connects via a computer 22, a wired communication means 25, and a client-side software program 28 to the central computer 60 and requests a copy of the driver's movement database 64 and the ancillary databases 65, 66, 67. By reviewing which motor vehicle is driven, the amount of driving, the driving routes, the time of driving, and the safety sensor information, the insurance company 18 is able to access the risk of lost to insure the driver 13 or motor vehicle 12.

In compliance with the statute, the invention described herein has been described in language more or less specific as to structural features. It should be understood, however, the invention is not limited to the specific features shown, since the means and construction shown comprise only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A driving record monitoring system, comprising:

a. a motor vehicle;

b. a monitoring device located in said motor vehicle;

c. a physical location detecting means coupled to said monitoring device, said physical location detecting means used to determine the physical location of said motor vehicle;

d. a wireless communication means connected to said monitoring device enabling said monitoring device to connect to a wireless communication network;

e. a wireless communication network located in the region where said motor vehicle is driven;

f. a wide area network connected to said wireless communication network;

g. a central computer connected to said wide area network, said central computer used to receive physical location information from said monitoring device when said motor vehicle is driving in said region;

h. a map database connected to said central computer containing roadway information of the region; and, i. a driver monitoring software program connected to said central computer, said driver monitoring software program capable of collecting said physical location information and using said map database to create a driving monitoring database for said motor vehicle.

2. The monitoring system, as recited in claim 1, further including means to input the driver's name to said central computer.

3. The monitoring system, as recited in claim 1, further including a traffic route database coupled to said central computer.

4. The monitoring system, as recited in claim 1, further including a roadway traffic database coupled to said central computer.

5. The monitoring system, as recited in claim 1, further including a traffic event database coupled to said central computer.

6. A method for determining the risk of lost of an insured motor vehicle or driver, comprising the following steps:

a. selecting a monitoring system that includes a monitoring device located in the insured motor vehicle, a physical location means coupled to said monitoring device, a wireless communication network, a wide area computer network connected to said wireless communication network, a central computer coupled to said wide area network computer network, and a movement database for said insured motor vehicle;

b. selecting the insured motor vehicle for driving.

c. activating the monitoring system to collect movement information from said monitoring device as said motor vehicle travels throughout the region covered by said wireless communication network;

d. driving the insured motor vehicle throughout the region covered by said wireless communication network;

e. reviewing the movement database; and, f. using the information in said movement database to assess the risk of loss to insure the driver or motor vehicle.

* * * * *

US006502020C1

(12) EX PARTE REEXAMINATION CERTIFICATE (5982nd)

United States Patent

Lang

(10) Number: US 6,502,020 C1

(45) Certificate Issued: Oct. 30, 2007

(54) DRIVING RECORD MONITORING SYSTEM AND METHOD

(76) Inventor: Brook W. Lang, 40 Lake Bellevue, Suite 100, Bellevue, WA (US) 98005

Reexamination Request:
No. 90/006,837, Oct. 30, 2003

Reexamination Certificate for:

| | |
|---|---|
| Patent No.: | **6,502,020** |
| Issued: | **Dec. 31, 2002** |
| Appl. No.: | **10/053,331** |
| Filed: | **Jan. 17, 2002** |

Related U.S. Application Data

(60) Provisional application No. 60/262,557, filed on Jan. 18, 2001.

(51) Int. Cl.
*G08G 1/13* (2006.01)

(52) U.S. Cl. ..... 701/29; 701/208; 701/213; 340/970

(58) Field of Classification Search ..... 701/29, 701/208, 213, 117; 340/920; 705/4
See application file for complete search history.

(56) References Cited

U.S. PATENT DOCUMENTS 5,323,322 A * 6/1994 Mueller et al. ..... 701/215
5,797,134 A * 8/1998 McMillan et al. ..... 705/400
5,842,125 A * 11/1998 Modzelesky et al. .... 455/426.1
5,945,919 A * 8/1999 Trask ..... 340/825.49
6,064,970 A * 5/2000 McMillan et al. ..... 705/4
6,430,496 B1 * 8/2002 Smith et al. ..... 701/117

* cited by examiner

*Primary Examiner*—Matthew C. Graham

(57) ABSTRACT

An ongoing driving habit monitoring system used by insurance companies to more accurately determine the driving habits of their policyholders or authorized drivers to more accurately determine their risk of loss. The system uses a monitoring device located in the insured party's motor vehicle. Each monitoring device is coupled to a GPS receiver, that provides physical location information, and to a wireless modem capable of connecting to a wireless communication network. The system also includes a central computer connected to a wide area network that is able to continuously or intermittently receive movement information from the monitoring device as it travels in a specific region covered by the wireless communication network. The central computer uses a driving monitoring software program and several ancillary databases containing roadway information for a region, route information, and traffic pattern information. Insurance companies or other authorized users of the system are able to log onto the central computer to the information in the database.

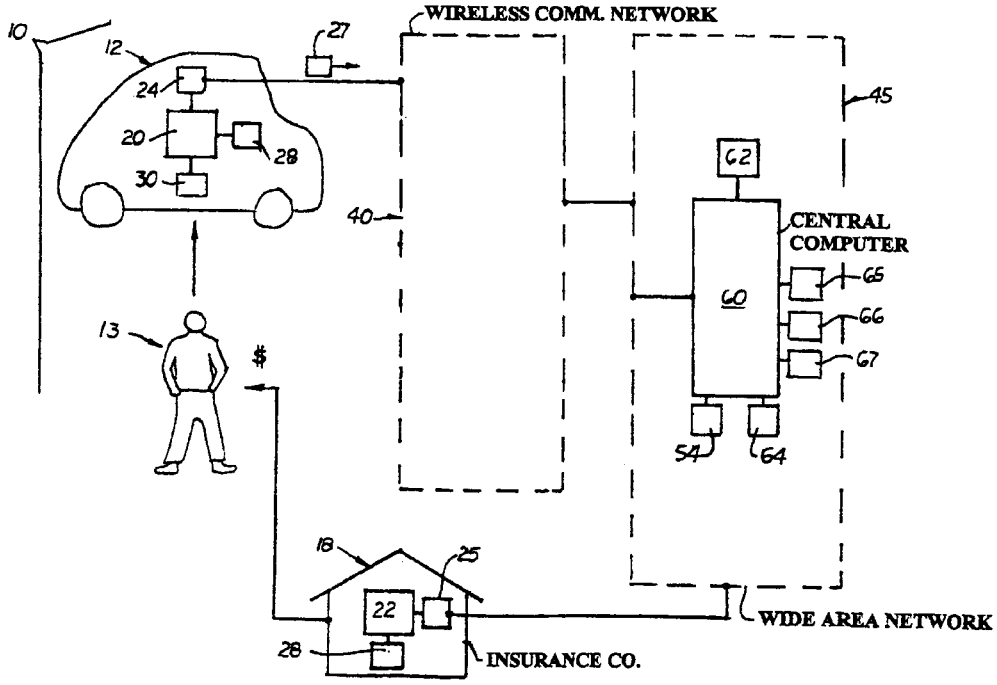

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *